United States Patent [19]

Gibson

[11] 4,106,169

[45] Aug. 15, 1978

[54] SEAL LUBRICATION IN A ROTARY ENGINE

[75] Inventor: Myron R. Gibson, Edelstein, Ill.

[73] Assignee: Caterpillar Tractor Co., Peoria, Ill.

[21] Appl. No.: 612,600

[22] Filed: Sep. 12, 1975

[51] Int. Cl.[2] ..... B23P 15/00; F01C 21/04

[52] U.S. Cl. ..... 29/156.4 R; 29/149.5 PM; 29/445; 418/90

[58] Field of Search ..... 418/49–53, 418/90, 97–99, 76; 184/6, 6.16, 15 A; 29/445, 156.4 R, 149.5 PM; 308/9, DIG. 5; 415/110–112

[56] References Cited

U.S. PATENT DOCUMENTS

| | | | |
|---|---|---|---|
| 2,361,855 | 10/1944 | McCormack | 418/98 |
| 2,604,958 | 7/1952 | Leufvenius | 308/DIG. 5 |
| 3,339,670 | 9/1967 | McGrern, Jr. et al. | 418/99 |
| 3,393,770 | 7/1968 | Fertik et al. | 418/90 X |
| 3,485,218 | 12/1969 | Clarke | 418/53 |
| 3,811,806 | 5/1974 | King | 418/90 |
| 3,814,555 | 6/1974 | Casey | 418/99 |
| 3,819,304 | 6/1974 | Demers | 418/88 |
| 3,820,924 | 6/1974 | Cassidy | 418/97 |
| 3,844,691 | 10/1974 | Dobler | 418/97 |
| 3,923,434 | 12/1975 | Walters | 418/91 |
| 3,990,818 | 11/1976 | Loyd, Jr. | 418/97 X |
| 3,995,600 | 12/1976 | DeLuca et al. | 418/90 X |

*Primary Examiner*—Carlton R. Croyle
*Assistant Examiner*—Leonard Smith
*Attorney, Agent, or Firm*—Wegner, Stellman, McCord, Wiles & Wood

[57] ABSTRACT

An improved slant axis rotary mechanism including a housing defining an operating chamber, the operating chamber having an outer spherical wall, an inner spherical wall and opposed, generally radially extending end walls extending between the inner and outer spherical walls. A rotor is located within the chamber and includes a spherical hub carrying seals engaging the inner spherical wall and an annular flange carrying seals engaging both the end and outer spherical walls. A shaft is journalled in the housing and has an angularly offset portion within the chamber which, in turn, journals the rotor and gears carried by the rotor and the housing establish a timed rotary relationship between the shaft and the rotor. At least one elongated slot is provided in one of the walls and opens into the chamber. Means are provided for supplying a lubricant to the slot for lubricating the seal on the rotor engaging the wall having the slot. Also disclosed is a method for forming a lubricating outlet in the wall of an operating chamber of a rotary mechanism.

4 Claims, 4 Drawing Figures

Fig. 1
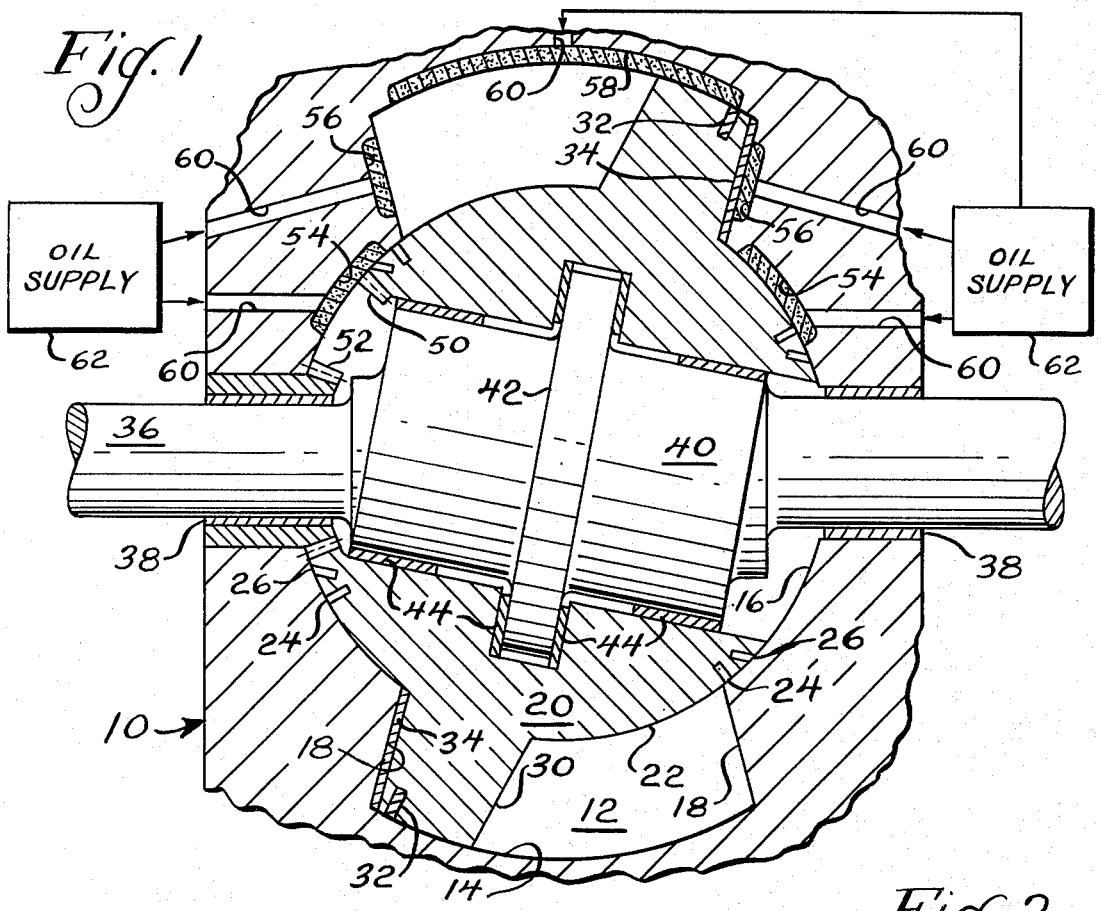
Fig. 2
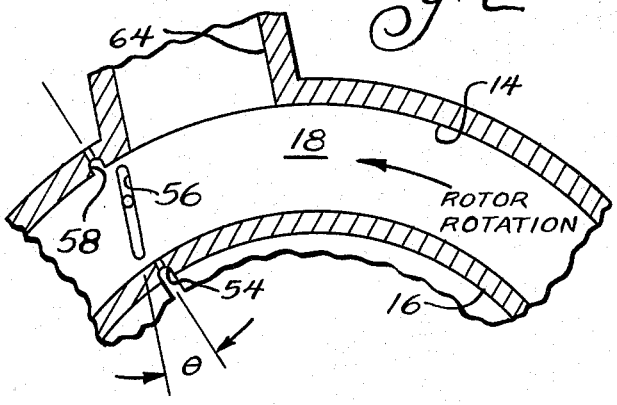
Fig. 3
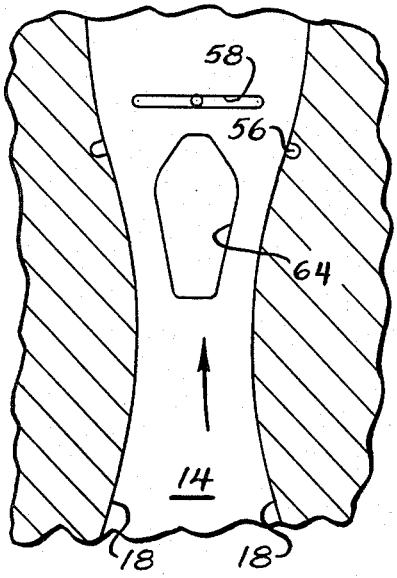
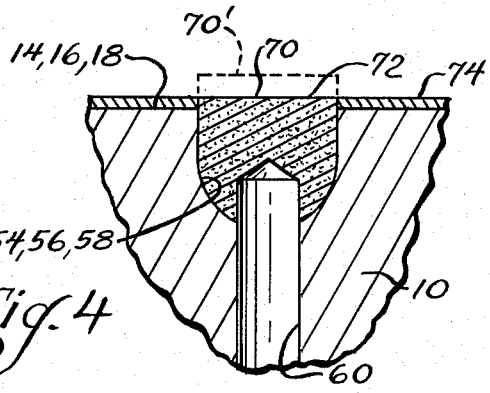
Fig. 4

SEAL LUBRICATION IN A ROTARY ENGINE

BACKGROUND OF THE INVENTION

This invention relates to slant axis rotary engines, and, more particularly, to improved means for lubricating the seals of such engines.

Prior art of possible relevance includes the following U.S. Patents: No. 3,811,806 issued on May 21, 1974 to King; No. 3,814,555 issued June 4, 1974 to Casey; and No. 3,819,304 issued June 25, 1974 to Demers.

In the majority of various types of rotary engines, lubrication oil for seals carried by the rotor is introduced either into the induction system to be mixed with either the fuel-air mixture or air alone, or is introduced on the walls of the housing just downstream of the intake port. Heretofore, such approaches have been restricted to trochoidal engines where the lubrication of but two housing surfaces is required. Thus, there remains a need for a lubrication system applicable to slant axis rotary type mechanisms where three surfaces require such lubrication.

SUMMARY OF THE INVENTION

It is the principal object of the invention to provide a new and improved slant axis rotary mechanism. More specifically, it is an object of the invention to provide an improved means for lubricating the walls and seals employed in such mechanisms. It is also an object of the invention to provide a method of forming lubrication outlets in the walls of rotary mechanisms.

The exemplary embodiment of the invention achieves the foregoing object in a construction including a housing having an operating chamber. The operating chamber, in turn, includes an outer spherical wall, an inner spherical wall and opposed, generally radially extending end walls extending between the inner and outer spherical walls. A rotor is disposed within the chamber and has a spherical hub carrying seals engaging the inner spherical wall as well as an annular flange carrying seals engaging the end and outer spherical walls. A shaft having an angularly offset portion is journalled in the housing with the offset portion within the chamber and journalling the rotor therein. Means are provided on the rotor and on the housing for establishing a timed rotary relationship between the shaft and the rotor. At least one elongated slot is formed in one of the walls and opens into the chamber and means are provided for supplying a lubricant to the slot for lubricating the seal on the rotor engaging the wall containing the slot.

According to a highly preferred embodiment of the invention, the slot is occupied by a porous insert which acts as a distributing wick for a liquid lubricant. In addition, all of the walls are provided with such slots.

Where the mechanism includes an intake port opening into the operating chamber, the slot is located just downstream of the port in the direction of rotor rotation and preferably extends in a direction nonparallel to the longitudinal extent of the seal engaging the wall in which the slot is formed.

A preferred method of forming a lubrication outlet for lubricating seals carried by a rotor and a rotary mechanism includes the steps of forming a recess in the wall of the operating chamber, filling the recess with an insert formed of a sintered metal and of a size sufficient to extend into the operating chamber, securing the insert in the recess, hardening the wall, and finish machining the wall and the insert.

According to a highly preferred embodiment of the method, the step of securing the insert in the recess is performed by brazing. In addition, the step of brazing is followed by the step of providing a lubricant conduit in the housing extending to the interior of the insert. Preferably, the recess is in the form of a slot in the wall extending in a direction nonparallel to the longitudinal extent of the seal to engage the wall.

Other objects and advantages will become apparent from the following specification taken in connection with the accompanying drawings.

DESCRIPTION OF THE DRAWINGS

FIG. 1 is a sectional view of a slant axis rotary mechanism made according to the invention;

FIG. 2 is a fragmentary, sectional view;

FIG. 3 is a fragmentary, developed view of the mechanism; and

FIG. 4 is a fragmentary, enlarged, sectional view of a preferred form of the invention.

DESCRIPTION OF THE PREFERRED EMBODIMENT

An exemplary embodiment of a slant axis rotary mechanism in the form of a four-cycle slant axis rotary engine is illustrated in FIG. 1. However, it is to be understood that the invention is not limited to a four-cycle engine but may be advantageously employed with mechanisms other than engines, such as compressors, pumps or the like and may be advantageously employed with mechanisms having a number of cycles other than four.

The engine includes a housing, generally designated 10, defining an operating chamber 12. The operating chamber 12 is bounded by an outer spherical wall 14, an inner spherical wall 16, and opposed, generally radially extending side walls 18 which extend between the inner spherical wall 16 and the outer spherical wall 14. Those skilled in the art will recognize that the walls 18 are not truly radially extending but can assume a variety of configurations depending upon the number of cycles of the mechanism. For example, for a four-cycle engine, the walls 18 will be an undulating frusto-cone.

Within the operating chamber 12, a rotor 20 is disposed. The same includes a spherical hub 22 carrying compression seals 24 and oil seals 26 in engagement with the inner spherical wall 16. The rotor 20 also includes an annular flange 30 carrying peripheral seals 32 in engagement with the outer spherical wall 14 and apex seals 34 engaging the radially extending walls 18.

A shaft 36 is journalled, as by bearings 38, in the housing 10 and includes an angularly offset portion 40 which, by means of a thrust collar 42, and a variety of bearings 44, journals the rotor 20 within the operating chamber 12.

One end of the rotor hub 22 includes an internal ring gear 50 which is in engagement with a stationary gear 52 carried by the housing 10 to establish a proper time relationship between the relative rates of rotation of the rotor 20 and the shaft 36. In a typical four-cycle mechanism, the shaft 36 will rotate through three revolutions for every single revolution of the rotor 20.

Opposite sides of the inner spherical wall 16 are provided with slot-like, elongated recesses 54. The slots 54 are preferably oriented at 90° to the mean position of the seals 24 and 26. Stated another way, the slots 54 are elongated in a direction nonparallel to the mean direction of elongation of the seals 24 and 26. Similar slots or recesses 56 are provided, one in each of the radially extending walls 18. The slots 56 are located at any suitable angle such as the angle $\theta$ illustrated in FIG. 2 so as to be elongated in a direction nonparallel to the elongated extent of the seal to pass over the slot, here the apex seals 34.

The outer spherical wall 14 is provided with a similar slot 58 which is elongated and preferably is disposed at about 90° to the mean direction of travel of the rotor surface, here the surface of the flange 30, but in any event, nonparallel to the longitudinal extent of the seal engaging the outer spherical surface 14, namely, the peripheral seals 32.

Conduits 60 are provided in the housing 10 to establish fluid communication with a lubricating oil supply, schematically illustrated at 62, which may comprise a conventional, small volume pump for delivering the required amount of lubricant to the slots 54, 56 and 58. Once the oil has reached the slots 58, as the mechanism operates, the seals 24, 32 and 34, as they move across the slots, will smear the oil along the respective walls to achieve suitable lubrication.

As best illustrated in FIGS. 2 and 3, where the mechanism includes an intake port 64, it is preferable that the slots 54, 56 and 58 be located just downstream, in the direction of rotor rotation, from the port 64. When the mechanism is employed as an engine, the area just downstream of the intake port is perhaps the coolest region in the housing, with the result that, upon introduction of the oil, damaging effects on the oil by heat are minimized.

According to a highly preferred embodiment of the invention, each of the slots 54, 56 and 58 is filled with a porous insert 70 (FIG. 4) which acts as a wick to provide for uniform distribution of the lubricating oil.

According to the invention, the method of forming a lubricating outlet for a rotary mechanism includes the steps of forming a recess, such as the recesses 54, 56 or 58, in the wall, such as the walls 14, 16 or 18. The recess 54, 56, 58 is then filled with an insert 70, preferably formed of sintered metal. The insert 70, at the time it is placed in the recess, must be of sufficient size to extend into the operating chamber as, for example, designated by the dotted line 70' in FIG. 4.

Thereafter, the insert 70 is secured in the recess. Preferably, for ruggedness, the step of securing is performed by brazing the sintered metal insert 70 into the recess.

Thereafter, the wall of the operating chamber with which the insert 70 is associated is hardened in the conventional manner. Following hardening, the wall is then finish machined in the conventional way with the consequence that the exposed surface 72 of the insert will be flush with the hardened layer 74 on the wall of the operating chamber.

At any time following the step of securing the insert 70 within the recess, the step of providing a lubricant conduit 60 may be performed. It is desirable that the conduit extend into the interior of the insert 70. Normally, the step of forming the conduit will be performed by drilling.

The inventive method allows the insert 70 to be located securely in place and precludes the possibility of plugging of its outer surface 72 during the securing operation. Specifically, any plugged portion of the surface is machined away during the finish machining of the wall.

Similarly, by forming the conduit 60 after the securing operation, and extending the conduit into the interior of the insert 70, there is no possibility that materials employed in the securing operation can plug the conduit 60.

From the foregoing, it will be appreciated that the invention provides new and improved means for the lubrication of slant axis rotary engines and a new and improved method for providing lubrication outlets in rotary engines. By reason of the preferred orientation of the slots with respect to rotor or seal travel, the possibilities of the seals hanging up on the slots is eliminated. In addition, the use of the porous inserts enables uniform oil distribution along the length of the slot without requiring multiple delivery conduits and eliminating the possibility of oil starvation problems adjacent the ends of the slot.

What is claimed is:

1. A method of forming a lubrication outlet for lubricating a seal carried by a rotor in a rotary mechanism having a housing defining an operating chamber having a wall engaged by the seal, comprising the steps of (a) forming a recess in the wall, (b) filling the recess with an insert formed of sintered metal and of a size sufficient to extend into the operating chamber, (c) securing the insert in the recess, (d) hardening the wall, and (e) finish machining the wall and the insert.

2. The method of claim 1 wherein step (c) is performed by brazing.

3. The method of claim 1 wherein step (c) is followed by the step of providing a lubricant conduit in the housing extending to the interior of said insert.

4. The method of claim 1 wherein step (a) is performed by forming a slot in the wall extending in a direction nonparallel to the longitudinal extent of the seal to engage the wall.

* * * * *